United States Patent [19]

Uuskallio

[11] Patent Number: 5,014,897

[45] Date of Patent: May 14, 1991

[54] STAPLE GUN DRIVER GUIDE ASSEMBLY

[75] Inventor: Arvo F. Uuskallio, Hartland, Wis.

[73] Assignee: Briggs & Stratton Corporation, Wauwatosa, Wis.

[21] Appl. No.: 439,614

[22] Filed: Nov. 20, 1989 (Under 37 CFR 1.47)

[51] Int. Cl.[5] ..... B25C 5/00

[52] U.S. Cl. ..... 227/119; 227/120; 227/136; 227/139

[58] Field of Search ..... 227/109, 119, 120, 46, 227/47, 139

[56] References Cited

U.S. PATENT DOCUMENTS

| | | | |
|---|---|---|---|
| 2,637,030 | 5/1953 | Wickman et al. | 227/151 |
| 2,853,707 | 9/1958 | Juilfs | 227/139 X |
| 2,946,060 | 7/1960 | Powers | 227/151 |
| 3,205,787 | 9/1965 | Volkmann . | |
| 3,279,672 | 10/1966 | McKee | 227/154 |
| 3,283,986 | 11/1966 | McKee | 227/151 |
| 3,504,840 | 4/1970 | Wandfol et al. | 227/120 X |
| 3,670,941 | 6/1972 | Grinnell et al. | 227/159 X |
| 3,822,816 | 7/1974 | Doyle | 227/119 X |
| 4,072,261 | 2/1978 | Livio | 227/136 X |
| 4,087,035 | 5/1978 | Harmon | 227/120 |
| 4,252,260 | 2/1981 | Burton | 227/119 |
| 4,380,312 | 4/1983 | Landrus | 227/116 |
| 4,552,296 | 11/1985 | Sheng | 227/109 |
| 4,553,689 | 11/1985 | Wilkerson | 227/139 |

OTHER PUBLICATIONS

Operation and Maintenance Manual, distributed by Bostich Company, 1986.

*Primary Examiner*—Paul A. Bell

*Attorney, Agent, or Firm*—Andres, Sceales, Starke & Sawall

[57] ABSTRACT

A tool for applying fasteners to a workpiece includes a housing, a fastener driving mechanism for driving a fastener through a driveway, a fastener guide assembly containing the driveway, a fastener magazine for holding and sequentially feeding fasteners to the guide assembly, and an arrangement for properly positioning the driveway relative to the workpiece. The fastener guide assembly includes a head through which the fasteners are driven, and the positioning arrangement includes a pair of opposite beveled surfaces on the sides of the head for longitudinally aligning the driveway relative to the workpiece, and a substantially U-shaped channel in the bottom face of the head for longitudinally aligning the driveway relative to the workpiece.

3 Claims, 2 Drawing Sheets

FIG. 1
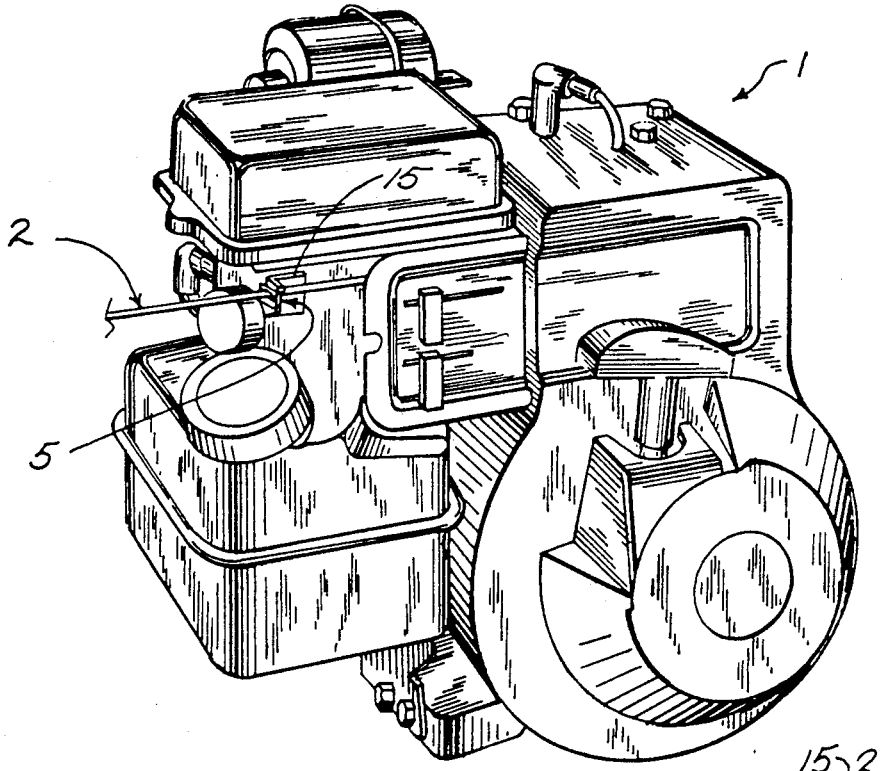
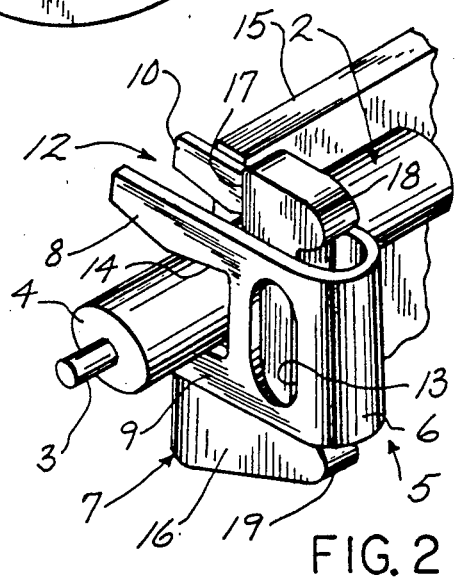
FIG. 2
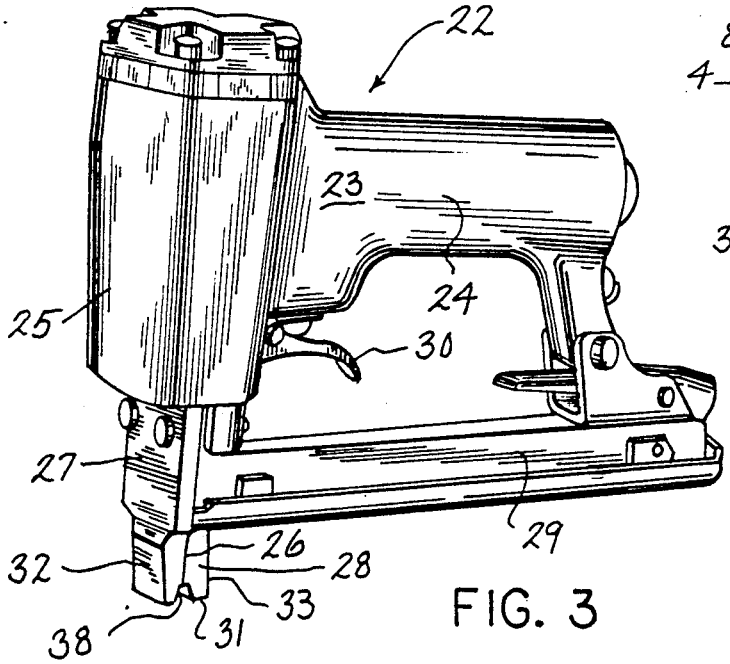
FIG. 3

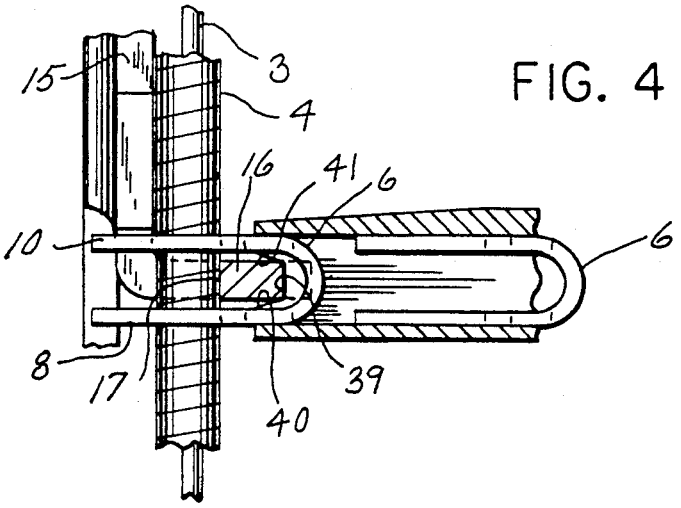
FIG. 4
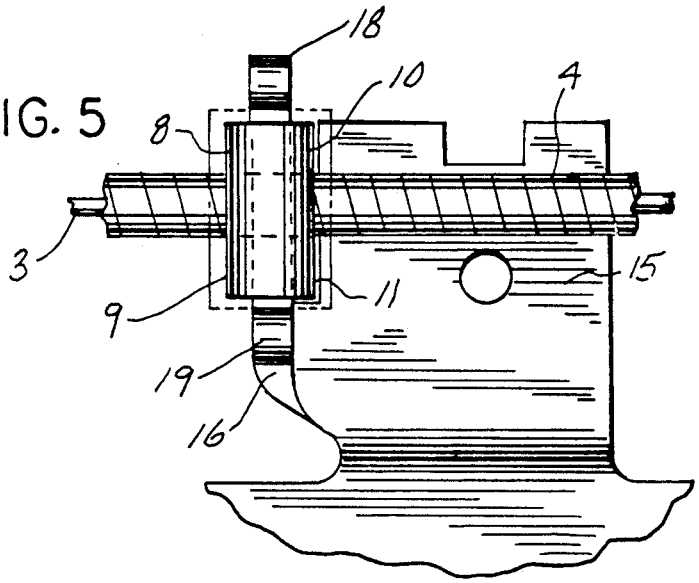
FIG. 5
FIG. 6
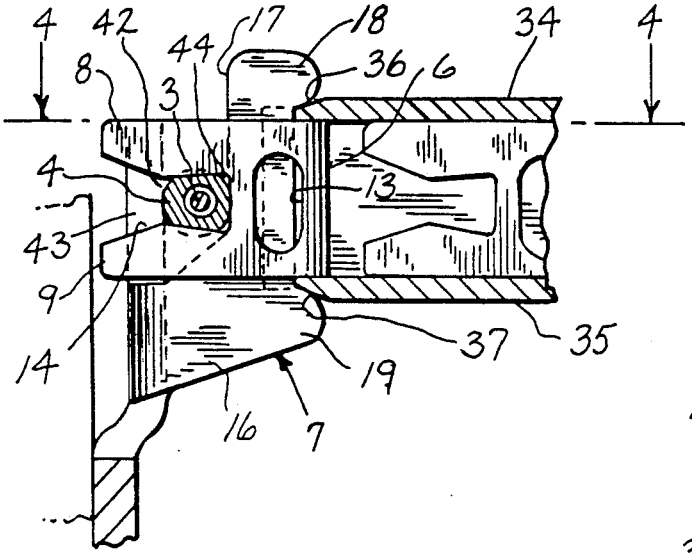
FIG. 7
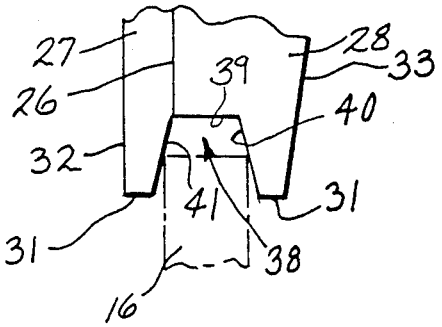

STAPLE GUN DRIVER GUIDE ASSEMBLY

BACKGROUND OF THE INVENTION

The present invention relates to fastening devices and more particularly to a tool for applying a clip to a mounting bracket for fixedly mounting on an engine a remote control cable that controls the speed of the engine.

The speed of small internal combustion engines employed with lawn and garden equipment, such as lawn mowers, is typically controlled by a remote speed control cable having one end connected to a remote speed control lever movable by an operator and its other end connected to a speed control lever on the engine. Such remote control cables generally employ a control wire slidably contained in a surrounding casing. The casing may be metal, plastic and/or combinations thereof depending upon the particular application.

Various types of cable clamps may be employed for attaching the remote speed control cable to an engine component. One such clamp includes a clip member removably attachable to the cable casing having a body extending substantially perpendicular to the longitudinal axis of the cable. The clip member is substantially U-shaped with each side of the U having a bifurcated end defining a pair of legs having aligned cable-receiving openings dimensioned to tightly engage the casing of the cable. Each cable-receiving opening has a constricted middle section forming a throat and is similar in shape to an hour glass.

Such clips may be employed with a mounting bracket projecting from an engine component which includes an upstanding support member about which opposite sides of the U-shaped clip member are disposed. The clip member is prevented from moving axially on the mounting bracket by the bracket itself, and a pair of vertically spaced apart projecting bosses on the outer end of the upstanding bracket member prevent lateral and/or rotational movement of the clip member.

In order to assemble the clip member on the mounting bracket, a tool such as a hammer is typically employed in such a manner that after the cable is properly manually positioned the clip member is struck with the hammer to drive the clip member onto the mounting bracket. Such a manual process is relatively slow and may result in injuries to a user's fingers and/or hand due to the need to physically hold the clip member in position while striking it with the hammer. It is therefore desirable to automate the assembly process and provide a power operated tool that could easily be properly located with respect to the bracket in order to quickly and accurately apply a fastener about the bracket.

SUMMARY OF THE INVENTION

A tool for accurately applying a fastener to a workpiece. The tool is particularly adapted for applying a clip member to an upstanding bracket projecting from an engine component to fixedly mount one end of a remote speed control cable thereon. In such an application, the tool quickly and accurately applies a fastener to fixedly mount the remote speed control cable.

The tool comprises a housing, fastener driving means in the housing for driving a fastener through a driveway, fastener guide means aligned with the fastener driving means, having the driveway therein with an upper receiving end and a lower discharge end, a fastener magazine defining a longitudinal dimension for holding and sequentially feeding fasteners to the fastener guide means, and positioning means on the fastener guide means including longitudinal alignment means for longitudinally aligning the driveway relative to the workpiece and lateral alignment means for laterally aligning the driveway relative to the workpiece.

The fastener guide means preferably comprises a head disposed at one end of the magazine, and the driveway comprises a passageway extending through the head. The head includes a bottom face, a front face, a rear face and a pair of opposing side faces, and the lateral alignment means includes a pair of opposite beveled surfaces formed in the side faces of the head tapering downwardly and inwardly from the side faces to the bottom face. This permits accurate positioning of the head of the tool between the projecting bosses on the bracket. The longitudinal guide means preferably comprises a substantially U-shaped laterally extending recess or channel formed in the bottom face of a head. Preferably, the U-shaped recess includes a web portion communicating with the driveway and a pair of opposite diverging tapered surfaces angled downwardly and outwardly from the web portion to the bottom face. The dimension of the web portion of the U-shaped channel is less than the thickness of the upstanding bracket to permit accurate positioning of the head of the tool on the end of the bracket.

In one preferred form, the tool is in the form of a staple gun with the driveway formed between the mating surfaces of a driver guide assembly and a staple guide assembly.

BRIEF DESCRIPTION OF THE DRAWINGS

The drawings illustrate the best mode presently contemplated of carrying out the invention.

In the drawings:

FIG. 1 is a perspective view of a small internal combustion engine incorporating a cable clamp of the type to be assembled with the tool of the present invention;

FIG. 2 is a fragmentary enlarged perspective view of the cable clamp;

FIG. 3 is a perspective view of a tool for applying the clip to the mounting bracket of the cable clamp of FIG. 2;

FIG. 4 is a top plan view illustrating the driving of a clip member onto the bracket member of the cable clamp taken along the plane of the line 4—4 in FIG. 6;

FIG. 5 is a fragmentary front elevational view of the cable clamp showing the position of the head of the tool in dashed lines;

FIG. 6 is a side elevational view illustrating the driving of a clip member onto the bracket of the cable clamp; and FIG. 7 is a fragmentary end view in elevation of the head of the tool.

DESCRIPTION OF THE PREFERRED EMBODIMENT

Referring now to the drawings, FIG. 1 illustrates a small internal combustion engine, generally designated by the numeral 1, for use in connection with lawn and garden equipment, such as lawn mowers. Engine 1 includes a speed control lever (not shown) which is pivotably mounted on engine 1 having one end projecting from engine 1 and its other end operatively connected to the carburetor of engine 1 for controlling the speed of engine 1.

A remote speed control cable 2 is typically used with lawn and garden equipment such as lawn mowers to control the speed of engine 1 by pivoting or moving the engine speed control lever. In FIG. 2, cable 2 defines a longitudinal axis and includes a metal control wire 3 slidably mounted within a surrounding plastic casing or jacket 4. As is well known and conventional in this art, one end or the upper end of control wire 4 is connected to a remote speed control lever which is pivotably mounted within a speed control box (not shown). The speed control box is typically mounted on the handle assembly of a lawn mower for manual movement of the lever by an operator. The other end or lower end of the control wire 4 is connected to the projecting end of the engine speed control lever. The casing 4 of cable 2, in turn, has its upper end fixed to the control box and its lower end fixedly mounted on engine 1 by a cable clamp 5. Thus, movement of control wire 3 by an operator pivoting the remote speed control lever results in movement of the engine speed control lever which, in turn, controls the speed of engine 1.

Turning again to FIG. 2, there is illustrated in more detail the components of cable clamp 5. Cable clamp 5 includes a metal clip member 6 removably attachable to casing 4 and a mounting bracket 7 integrally formed on the side of engine 1 for receiving and removably mounting clip member 6 thereon. Clip member 6 comprises an elongated, relatively flat U-shaped body with each side of the U-shaped body terminating in a bifurcated end. Each bifurcated end of each side of the U-shaped body thus forms a pair of spaced apart legs 8, 9 and 10, 11 (not shown), respectively. The upper or head ends of the sides of the U-shaped body are integrally interconnected to form the web portion thereof and define an elongated slot 12 extending between the substantially parallel sides of the U-shaped body of clip member 6. The upper or head end of each of the sides of the U-shaped body also includes an oblong tool-receiving opening 13 respectively, formed therethrough. As shown in FIG. 6, openings 13 are positioned such that when clip member 6 is in position on bracket 7 a portion thereof is disposed above bracket 7 such that the tip of a screwdriver or other suitable tool may be inserted therein to remove clip member 6 from bracket 7 for servicing and/or replacement, if necessary.

Each pair of legs define an aligned cable-receiving opening 14 therebetween, dimensioned to tightly engage casing 4 of control cable 2. Both openings 14 are identical in the shape of an hour glass and therefore, only one will be described hereinafter. In FIG. 6, opening 14 includes a constricted middle section 42 forming a throat, a first or lower end section 43 having opposite edges diverging from the throat to the toes of the legs of clip member 6, and a second or upper end section 44 having opposite edges also diverging from the throat to an upper edge 45 which is located between the throat and the head end of clip member 6.

The distance between the throat 42 of each opening 14 and the upper edge 45 thereof is at least equal to one half the diameter of cable 2 and preferably is slightly greater than the diameter of cable 2. Additionally, the distance between opposite edges of throat 42 is less than the diameter of cable casing 4, but greater than the diameter of control cable 2. The above dimensions ensure that the edges of the cable-receiving openings 14 "bite" into and tightly engage casing 4 of cable 2. Additionally, the location of throat 42 of each cable-receiving opening 14 with respect to the upper edge 45 thereof ensures an "overcenter" type positioning of cable 2 within openings 14, as best shown in FIG. 6, which thus prevents clip member 6 from backing off of cable 2 once cable 2 is positioned therein.

In FIG. 2, clamp 5 includes as one of its components a mounting bracket 7. Mounting bracket 7 is composed of a metal material and includes a flat base plate 15 mounted on an engine component and an upstanding flat support plate 16 projecting from base plate 15. Support plate 16 is spaced from base plate 15 to form a cable-receiving slot 17 therebetween. Support plate 16 is disposed in a plane substantially perpendicular to the plane containing base plate 15, so that support plate 16 also extends substantially perpendicular to the longitudinal axis of control cable 2. Upstanding support plate 16 includes a pair of vertically spaced apart bosses 18, 19 projecting from the upper and lower outer ends thereof. As best shown in FIGS. 5 and 6, bosses 18, 19 engage the opposite outside edges of the head of clip member 6 and function as abutments or stops for preventing lateral and/or rotational movement of clip member 6. Base plate 15 also includes an upper slot and a lower slot (not shown) for receiving and snugly engaging the toes of the legs 10, 11 of the bifurcated ends of the righthand side of clip member 6. These slots also aid in preventing lateral and/or rotational movement of clip member 6. It should also be noted that upstanding support plate 16 itself functions to prevent axial movement of clip member 6 with respect to the axis of control cable 2, since it is received within the elongated slot 12 formed between the opposite sides of clip member 6. Thus, once assembled, clip member 6 is prevented from moving axially since support plate 16 will engage the inner flat surfaces of clip member 6. Thus, clip member 6 is prevented from moving axially, laterally and/or rotationally.

In order to assemble cable clamp 5, control wire 3 is connected to the projecting end of the engine speed control lever and then cable 2 is placed between base plate 15 and support plate 16 in cable-receiving slot 17. Thereafter, clip member 6 is positioned, so that its sides straddle support plate 16 and the inside edges of its legs engage the surface of casing 4 of control cable 2. Clip member 6 is then driven onto bracket 7 and cable 2 into the position shown in FIG. 2 by means of the tool hereinafter to be described. The removal of clip member 6 may be accomplished by simply inserting another tool, such as a screwdriver, into either of the oblong openings 13 formed in the head end of the sides of the clip member 6. The screwdriver is then used as a lever to pry clip member 6 outwardly to separate clip member 6 from control cable 2 and bracket 7.

Referring now to FIG. 3, a tool generally designated by the numeral 22 is illustrated for applying clip member 6 onto bracket 7 and cable 2. Tool 22 includes a housing or body 23 having a manual grip portion 24 at its rearward end and a somewhat cylindrically shaped portion 25 at its forward end. Portion 25 houses a conventional fastener driving assembly (not shown) therein for driving clip member 6 through a driveway 26. The driving mechanism typically comprises a reciprocating anvil or piston member as is well known and conventional in the art, and therefore need not further be described herein. Tool 22 itself, as illustrated, is a conventional pneumatic staple gun available from the Bostich Company under model number TU 20, the head of which has been modified to incorporate the positioning means of the present invention. Driveway 26 is formed in the head of tool 22 by the abutting internal faces of a driver guide plate 27 at the front of body 23, and a fastener guide plate 28 connected to the forward end of a magazine 29. Magazine 29 defines a longitudinal dimension for tool 22 and as is well known in the art functions to hold and sequentially feed fasteners such as clip members 6 to driveway 26. Magazine 29 thus typically includes a push rod and biasing spring assembly to accomplish the above function. As is also well known in the art, a trigger 30 is employed to manually actuate the fastener driving assembly. As illustrated, tool 22 is a pneumatically operated manually actuatable device. However, tool 22 may also be hydraulically operated or may simply be manually actuatable without the power advantage of hydraulics or pneumatics, or may be roboticized for automatic remote operations.

Referring now to FIGS. 3 and 7, the lower end of driver guide plate 27 and fastener guide plate 28 form a head which includes a bottom face 31, a front face 32, a rear face 33, and two opposite side faces 34 and 35 (FIG. 6). In order to properly position driveway 26 with respect to bracket 7 so that clip member 6 may be driven onto bracket 7 with its legs on opposite sides thereof, the lower end of the head of tool 22 includes lateral alignment means for laterally aligning driveway 26 relative to bracket 7. This lateral alignment means comprises a pair of opposite beveled surfaces 36, 37 formed in the side faces 34, 35 which as best shown in FIG. 6, taper downwardly and inwardly from the side faces 34, 35 to bottom face 31. Beveled surfaces 36, 37 thus engage projecting bosses 18, 19 respectively on the outer end of bracket 7 and function to guide the head of tool 22 and driveway 26 so that they are properly positioned between bosses 18, 19 on bracket 7.

The head of tool 22 also includes a means for longitudinally aligning the driveway 26 relative to bracket 7. As shown best in FIG. 7, this longitudinal guide means comprises a substantially U-shaped recess or channel 38 formed bottom face 31. Channel 38 extends across the entire width of the head of tool 22 and opens into both beveled surfaces 36, 37. Channel 38 includes a web portion 39 communicating with driveway 26 and a pair of opposite diverging tapered surfaces 40, 41 angled downwardly and outwardly from web portion 39 to bottom face 31. Tapered surfaces 40, 41 function to engage the outer edge of bracket 7 to provide a positive positioning of driveway 26 with respect thereto. As shown best in FIG. 7, this positive locating function is a result of the distance between tapered surfaces 40, 41 at web portion 39 being less than the width of bracket 7.

A tool has been illustrated and described which provides a simple and reliable apparatus for applying a clip member 6 onto a bracket 7 to positively and fixedly mount the casing 4 of a control cable 2. Various modifications and/or substitutions may be made to the specific components described herein without departing from the scope of the invention.

Various modes of carrying out the invention are contemplated as being within the scope of the following claims particularly pointing out and distinctly claiming the subject matter regarded as the invention.

I claim:

1. A tool for applying a fastener to a mounting bracket, comprising:

a housing;

fastener driving means in said housing for driving a fastener through a driveway;

a fastener magazine defining a longitudinal axis for holding and feeding fasteners;

fastener guide means aligned with said fastener driving means and having said driveway therein that receives fasteners from said fastener magazine, said fastener guide means including a head having a bottom face and a pair of opposite side faces, said fastener guide means also including:

longitudinal alignment means for longitudinally aligning said driveway relative to the mounting bracket; and lateral alignment means for laterally aligning said driveway relative to the mounting bracket, said lateral alignment means comprising a pair of opposite beveled surfaces formed in said side faces tapering downwardly and inwardly from said side faces to said bottom face.

2. The tool according to claim 1, wherein said longitudinal alignment means comprises a substantially U-shaped channel formed in said bottom face.

3. The tool according to claim 2, wherein said U-shaped channel comprises a web portion communicating with said driveway and a pair of opposite diverging tapered surfaces angled downwardly and outwardly from said web portion to said bottom face.

* * * * *